US008136746B2

(12) United States Patent
Martin et al.

(10) Patent No.: US 8,136,746 B2
(45) Date of Patent: Mar. 20, 2012

(54) SYSTEM FOR CONTROLLING COAL FLOW IN A COAL PULVERIZER

(75) Inventors: William N. Martin, Brecksville, OH (US); Eric D. Fuller, Akron, OH (US)

(73) Assignee: Babcock & Wilcox Power Generation Group, Inc.

( * ) Notice: Subject to any disclaimer, the term of this patent is extended or adjusted under 35 U.S.C. 154(b) by 0 days.

(21) Appl. No.: 12/820,481

(22) Filed: Jun. 22, 2010

(65) Prior Publication Data

US 2010/0320298 A1 Dec. 23, 2010

(51) Int. Cl.
*B02C 15/00* (2006.01)

(52) U.S. Cl. ..... 241/19; 241/119; 241/291

(58) Field of Classification Search ..... 241/30, 241/117–121, 18, 19
See application file for complete search history.

(56) References Cited

U.S. PATENT DOCUMENTS

| | | | | |
|---|---|---|---|---|
| 5,003,891 | A | 4/1991 | Kaneko et al. | |
| 5,788,169 | A * | 8/1998 | Koenig | 241/236 |
| 6,347,757 | B1 * | 2/2002 | Takahashi et al. | 241/121 |
| 6,789,488 | B2 | 9/2004 | Levy et al. | |
| 6,966,508 | B2 * | 11/2005 | Levy et al. | 241/119 |
| 7,013,815 | B2 | 3/2006 | Levy et al. | |
| 7,549,382 | B2 | 6/2009 | Levy et al. | |
| 2004/0084556 | A1 | 5/2004 | Chen et al. | |
| 2010/0000450 | A1 | 1/2010 | Bilirgen et al. | |

FOREIGN PATENT DOCUMENTS

GB 1585410 A1 3/1981

OTHER PUBLICATIONS

PCT Search Report Dated Aug. 18, 2010 for PCT Patent Application No. PCT/US2010/039454.

* cited by examiner

*Primary Examiner* — Mark Rosenbaum
(74) *Attorney, Agent, or Firm* — Erie Marich

(57) ABSTRACT

The present invention relates generally to the field of coal flow in the outlet portion of a coal pulverizer, and in particular to a new and useful system/apparatus, method and drive means for controlling the position of one or more coal flow vanes in the upper portion of a coal pulverizer. The system and/or apparatus in accordance with the present invention utilizes a "cartridge" which is insertable into a turret at the top portion of a coal pulverizer, the present invention permitting the control of one or more coal flow vanes via an internal control system/means. In certain embodiments, the "cartridge" in accordance with the present invention encircles the raw coal inlet pipe, and is insertable into a turret at the top portion of a coal pulverizer, the present invention again permitting the control of one or more coal flow vanes via an internal control system/means.

21 Claims, 14 Drawing Sheets

SYSTEM FOR CONTROLLING COAL FLOW IN A COAL PULVERIZER

FIELD AND BACKGROUND OF THE INVENTION

1. Field of the Invention

The present invention relates generally to the field of coal flow in the outlet portion of a coal pulverizer, and in particular to a new and useful system/apparatus, method and drive means for controlling the position of one or more coal flow vanes in the upper portion of a coal pulverizer. The system and/or apparatus in accordance with the present invention utilizes a "cartridge" which is insertable into a turret at the top portion of a coal pulverizer, the present invention permitting the control of one or more coal flow vanes via an internal control system/means. In certain embodiments, the "cartridge" in accordance with the present invention encircles the raw coal inlet pipe, and is insertable into a turret at the top portion of a coal pulverizer, the present invention again permitting the control of one or more coal flow vanes via an internal control system/means.

2. Description of the Related Art

Semi-stationary devices (e.g., vanes) have long been used inside coal pulverizers for deflecting and distributing the pulverized coal/air stream. But to date, any system and/or method that permits control of such semi-stationary devices entails controlling the devices themselves from the surface thereof that is closest to the external surface of a coal pulverizer. While such systems are adequate for most instances, in the case of low turret, or no turret, pulverizers access from the external radial perimeter is often limited, or impossible.

Given the above, a need exists in the art for a control system, or means, that permits various coal flow devices (e.g., vanes) to be controlled via an internal surface located, for example, around the raw coal inlet pipe.

SUMMARY OF THE INVENTION

The present invention relates generally to the field of coal flow in the outlet portion of a coal pulverizer, and in particular to a new and useful system/apparatus, method and drive means for controlling the position of one or more coal flow vanes in the upper portion of a coal pulverizer. The system and/or apparatus in accordance with the present invention utilizes a "cartridge" which is insertable into a turret at the top portion of a coal pulverizer, the present invention permitting the control of one or more coal flow vanes via an internal control system/means. In certain embodiments, the "cartridge" in accordance with the present invention encircles the raw coal inlet pipe, and is insertable into a turret at the top portion of a coal pulverizer, the present invention again permitting the control of one or more coal flow vanes via an internal control system/means.

Accordingly, one aspect of the present invention is drawn to a system for controlling one or more coal flow vanes via an internal control system, the internal control system comprising: a cartridge assembly designed to operatively engage and/or be positioned in an upper portion of a coal pulverizer, the cartridge assembly comprising: at least one coal flow vane; and at least one drive, or actuating, means per coal flow vane, wherein the at least one drive, or actuating, means is operatively coupled to a coal flow vane, wherein the location of the cartridge assembly is selected so that the at least one coal flow vane can affect the output of pulverized coal in at least one outlet pipe of the coal pulverizer.

In yet another aspect of the present invention, there is provided a system for controlling one or more coal flow vanes via an internal control system, the internal control system comprising: a cartridge assembly designed to operatively engage and/or be positioned in an upper portion of a coal pulverizer, the cartridge assembly comprising: at least two coal flow vanes; and at least one drive, or actuating, means per coal flow vane, wherein the at least one drive, or actuating, means is operatively coupled to a coal flow vane, wherein the location of the cartridge assembly is selected so that the at least one coal flow vane can affect the output of pulverized coal in at least one outlet pipe of the coal pulverizer, and wherein the at least two coal flow vanes are positioned at equal intervals around an external surface of a coal inlet pipe of the coal pulverizer.

In yet another aspect of the present invention, there is provided a method for controlling the output of coal in a plurality of coal outlet pipes in a coal pulverizer, the method comprising the steps of: modifying, or retrofitting, a portion of a coal pulverizer with a cartridge assembly designed to operatively engage and/or be positioned in an upper portion of a coal pulverizer, the cartridge assembly comprising: at least one coal flow vane; and at least one drive, or actuating, means per coal flow vane, wherein the at least one drive, or actuating, means is operatively coupled to a coal flow vane; and controlling either independently, or in combination, the at least one coal flow vane so as to modifying, or control, the amount of coal exiting at least one coal outlet pipe in a coal pulverizer, wherein the location of the cartridge assembly is selected so that the at least one coal flow vane can affect the output of pulverized coal in at least one outlet pipe of the coal pulverizer.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which exemplary embodiments of the invention are illustrated.

DESCRIPTION OF THE INVENTION

The present invention relates generally to the field of coal flow in the outlet portion of a coal pulverizer, and in particular to a new and useful system/apparatus, method and drive means for controlling the position of one or more coal flow vanes in the upper portion of a coal pulverizer. The system and/or apparatus in accordance with the present invention utilizes a "cartridge" which is insertable into a turret at the top portion of a coal pulverizer, the present invention permitting the control of one or more coal flow vanes via an internal control system/means. In certain embodiments, the "cartridge" in accordance with the present invention encircles the raw coal inlet pipe, and is insertable into a turret at the top portion of a coal pulverizer, the present invention again permitting the control of one or more coal flow vanes via an internal control system/means.

Figure 1:
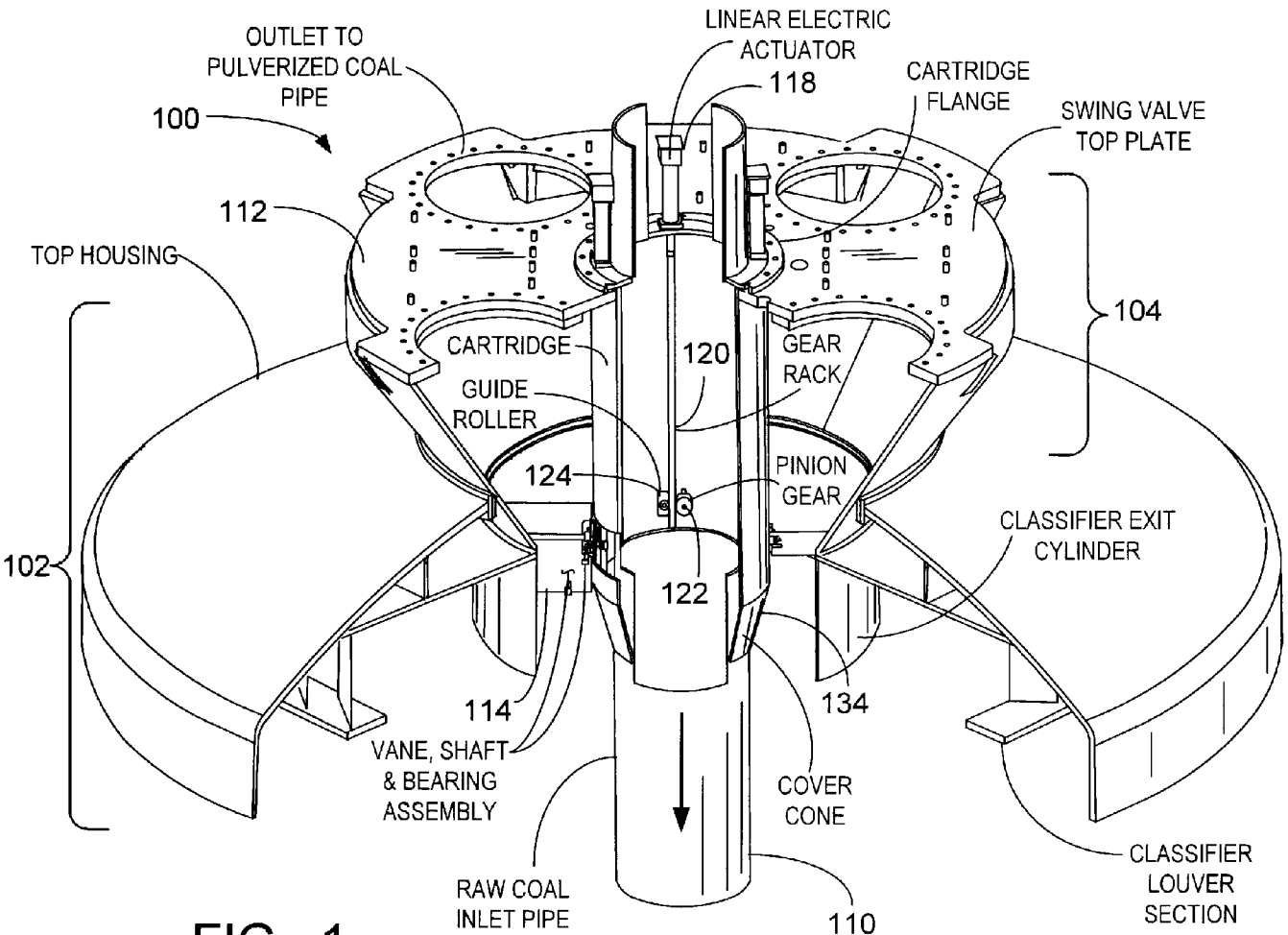
FIG. 1 is an isometric view, partly in section, of a pulverizer top housing and swing valve assembly provided with a system/apparatus for controlling the position of one or more coal flow vanes in the upper portion of a coal pulverizer in accordance with one embodiment of the present invention.
Figure 2:
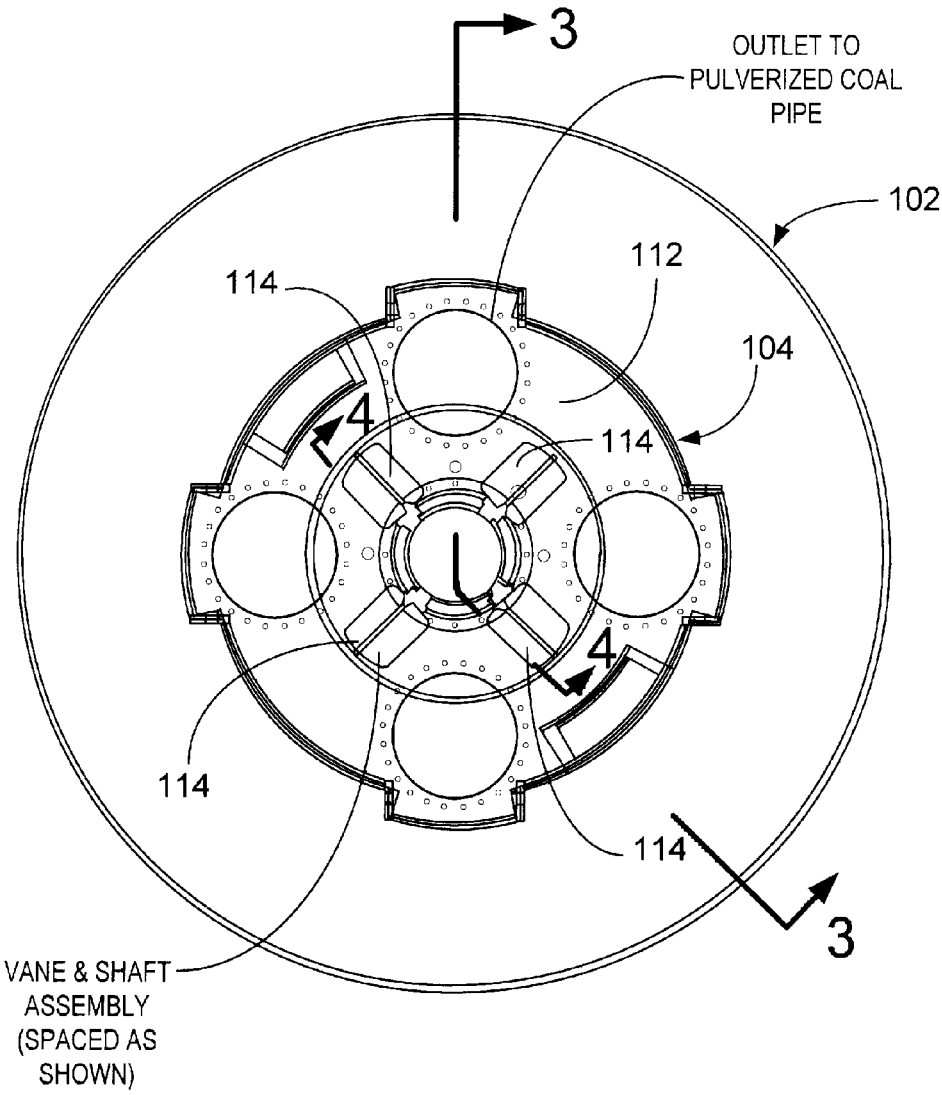
FIG. 2 is a plan view of the embodiment of FIG. 1.
Figure 3:
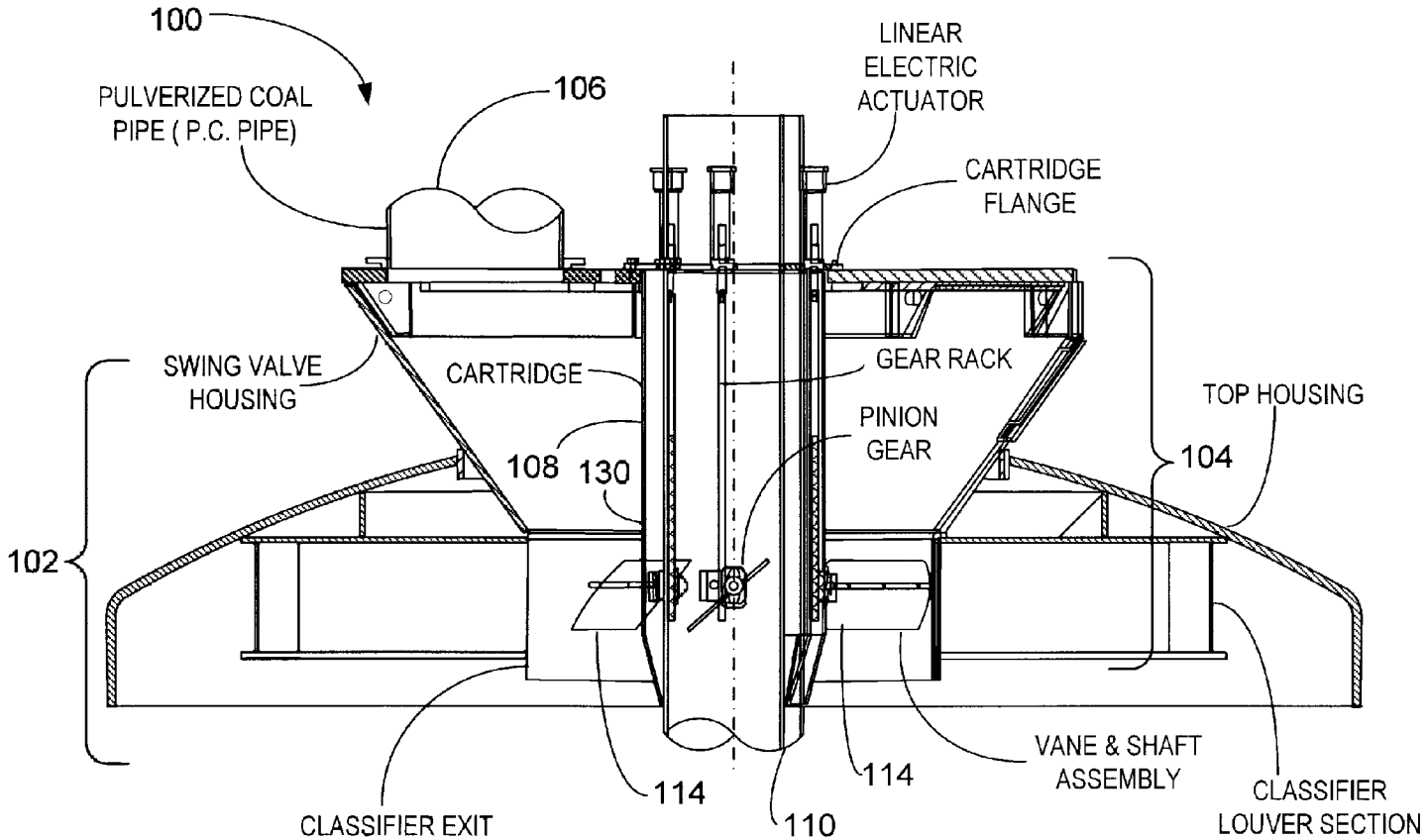
FIG. 3 is a cross-sectional view of FIG. 2 along the section 3-3 line of FIG. 2.
Figure 4:
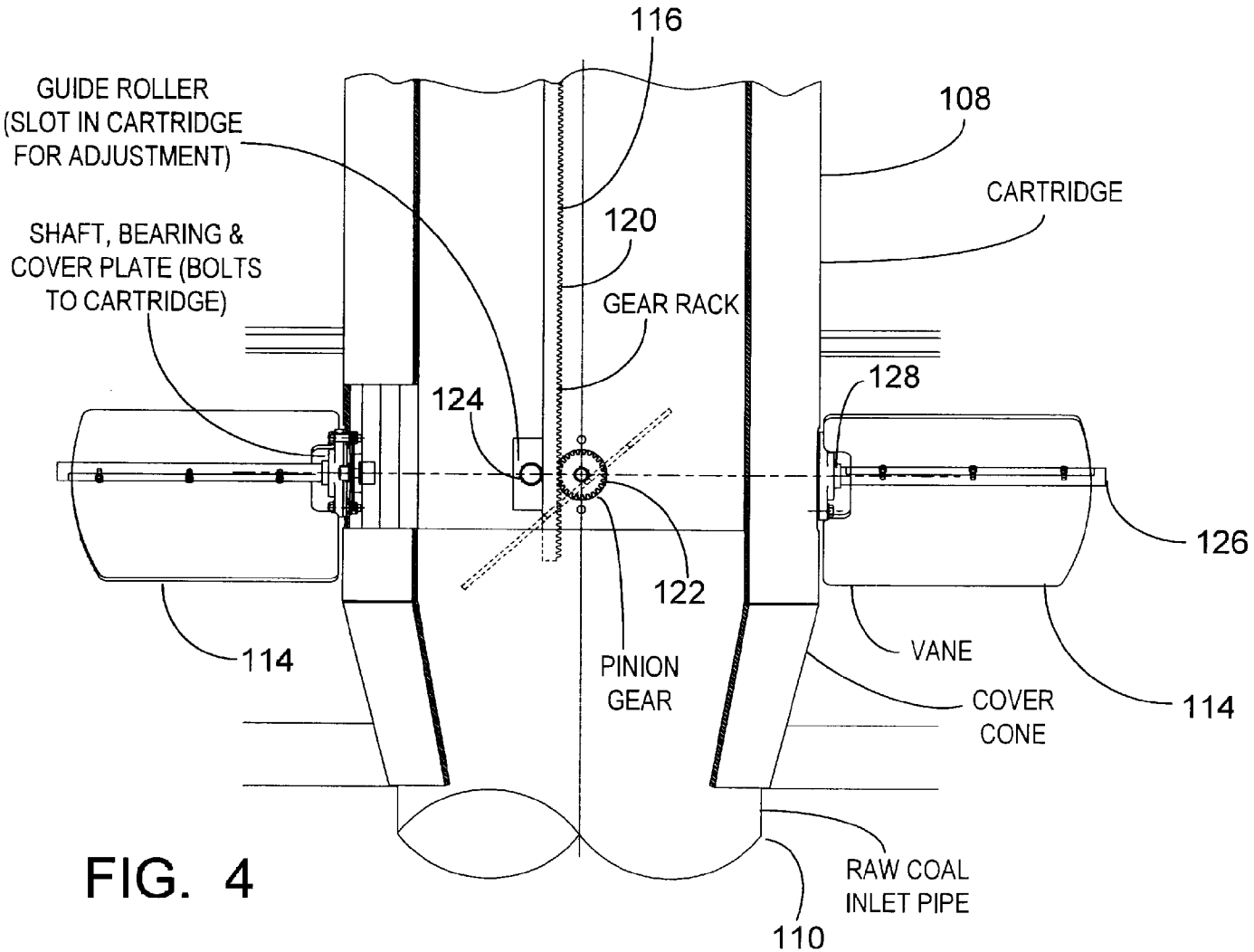
FIG. 4 is a cross-sectional close-up of FIG. 3 illustrating a cartridge assembly along the section 4-4 line of FIG. 2 in accordance with one embodiment of the present invention.

Referring to the Figures where like reference numerals refer to like parts, and in particular to FIGS. 1 through 6 which disclose an isometric view, partly in section, of a pulverizer top housing and swing valve assembly (see FIG. 1) in accordance with one embodiment of the present invention, a plan view of FIG. 1 (see FIG. 2), a cross-sectional view of FIG. 2 along the section 3-3 line of FIG. 2 (see FIG. 3), and a cross-sectional close-up view of FIG. 2 along the section line 4-4 of FIG. 2 illustrating the cartridge assembly of the present invention, the cartridge assembly having a drive means in accordance with one embodiment of the present invention (see FIG. 4).

As can be seen in FIG. 1, a top portion of a coal pulverizer 100 modified in accordance with one embodiment of the present invention, where coal pulverizer 100 comprises a top housing and related structure 102, a swing valve housing and related structure 104, where the swing valve housing and related structure 104 contain therein a plurality of coal outlets designed to be coupled to a plurality of pulverized coal outlet pipes 106 (see FIG. 3 where only one coal outlet pipe is shown for simplicity), and a cartridge assembly 108 (see FIG. 4). It should be noted that with regard to FIGS. 1 and 2, only the corresponding outlets in which a plurality of coal outlet pipes 106 reside are illustrated.

In one embodiment, cartridge assembly 108 is designed to be fitted, either initially or retroactively, around the external surface of coal inlet pipe 110 with the cartridge assembly 108 extending from just above the external surface of top plate 112 of swing valve housing 104 to a suitable point below the internal bottom extent of swing valve housing 104 (see FIG. 3). As can be seen from FIGS. 1 through 4, in one embodiment cartridge assembly 108 comprises four vanes 114 spaced approximately 90 degrees apart from one another. However, it should be noted that the present invention is not limited to any specific number of vanes or a pre-determined spacing between respective vanes. Rather, the present invention encompasses the use of any number of vanes equal to one or more, and to any arrangement of two or more vanes regardless of the amount of the spacing around, for example, a circular coal inlet pipe. In other words, in the instance where two or more vanes 114 are present in a cartridge assembly 108 according to the present invention, the spacing between adjacent vanes 114 can be regular intervals or irregular intervals of any amount or number of degrees.

In additional to the one or more vanes 114, cartridge assembly 108 comprises at least one drive, or actuating, means 116 per vane. In one embodiment, as illustrated in FIGS. 1 through 4, the one or more drive, or actuating, means 116 are rack and pinion drives that each have a control means 118 (e.g., a linear electric actuator) that is designed to permit the control of a gear rack 120 that operatively engages a pinion gear 122 and is held is place and able to be adjusted by guide roller 124. Each respective vane 114 is connected to rack and pinion drive means 116 via a shaft 126, and is permitted to be actuated as desired due to the presence of at least one bearing 128 and a protective cover plate located behind bearing 128 designed to prevent the inflow of coal dust into each respective drive means 116. In another embodiment, control means 118 could be any suitable type of control means that would permit the desired control of the rack and pinion control means 118 of FIGS. 1 through 4. Such control means 118 could include automated or manual mechanical control means, or automated or manual electrical control means.

In one embodiment, cartridge assembly 108 is designed to be fitted around the external surface of coal inlet pipe 110 and has only a generally concentric cartridge assembly pipe 130 having an internal surface that is spaced slightly apart from the external surface of coal inlet pipe 110. The amount of space formed between concentric cartridge assembly pipe 130 and the external surface of coal inlet pipe 110 should be of sufficient amount to permit the installation and operation of the one or more drive, or actuating, means 116 for each vane 114. In one embodiment, the space 132 (see FIG. 5) created between the concentric cartridge assembly pipe 130 and the external surface of coal inlet pipe 110 is sealed from contamination by coal dust using cover cone 134 and an appropriate sealing means for sealing the edge of cover cone 134 to the external surface of coal inlet pipe 110. Such suitable sealing means include, but are not limited to, a weldment, an adhesive, abrasion resistant sealing tapes, epoxy bonded graphite fabric, etc. As would be apparent to those of skill in the art, the type of sealing means for sealing the bottom end of cartridge assembly 108 depends in large part on the nature of the material used to manufacture coal inlet pipe 110. In the case where coal inlet pipe 110, concentric cartridge assembly pipe 130 and cover cone 134 are all made of compatible metal, or alloy, compounds, a suitable sealing means would be a weldment.

In another embodiment, cartridge assembly 108 can be formed by two concentric cartridge assembly pipes. In this embodiment, cartridge assembly 108 has an internal concentric cartridge assembly pipe designed to fit around the external surface of coal inlet pipe 110 and an external concentric cartridge assembly pipe designed to be separated by a suitable amount of space from the external surface of the internal concentric cartridge assembly pipe. The space formed between should be of suitable size to permit the installation and operation of the one or more drive, or actuating, means 116 for each vane 114. In this embodiment the bottom portion of cartridge assembly 108 can be sealed by a flat plate rather than cover cone 134.

Figure 5:
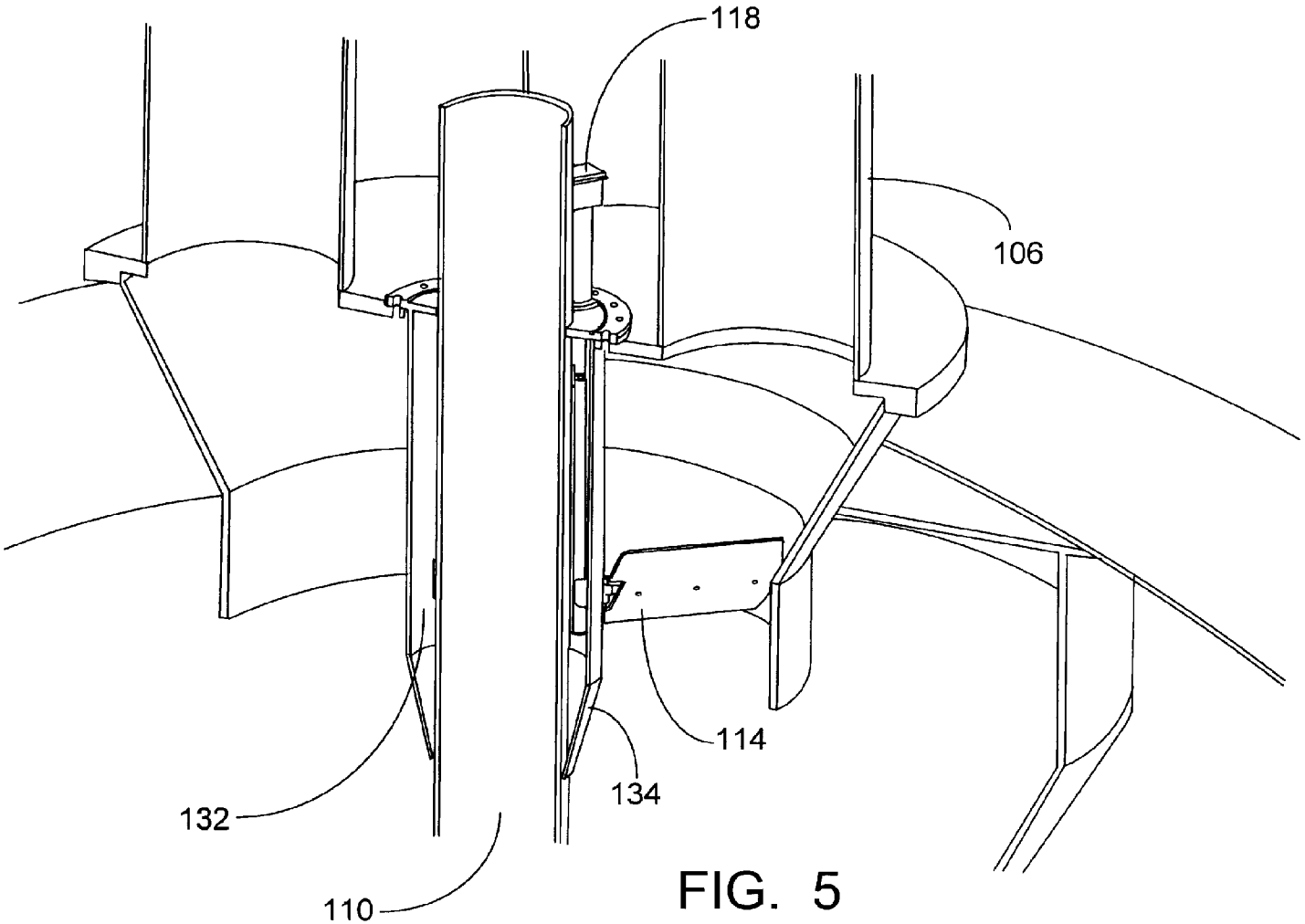
FIG. 5 is an isometric, close-up view, partly in section, of the top portion of a coal pulverizer that contains a cartridge assembly in accordance with one embodiment of the present invention.

FIG. 5 is an isometric close-up view of the cartridge assembly 108 of the embodiment of FIGS. 1 through 4. FIG. 5 shows various portions of the cartridge assembly of the present invention where the cartridge assembly has at least one vane 114. It should be noted that the present invention is not limited to any certain number of vanes so long as cartridge assembly 108 has at least one vane 114 and the means to control the vane 114. In another embodiment, the number of vanes 114 utilized in connection with cartridge assembly 108 is equal to the number of coal outlet pipes 106. In still another embodiment, any number of vanes 114 equal to two or more can be utilized in connection with cartridge assembly 108 with the total number of vanes 114 being selected independently of the number of outlet pipes 106.

Figure 6:
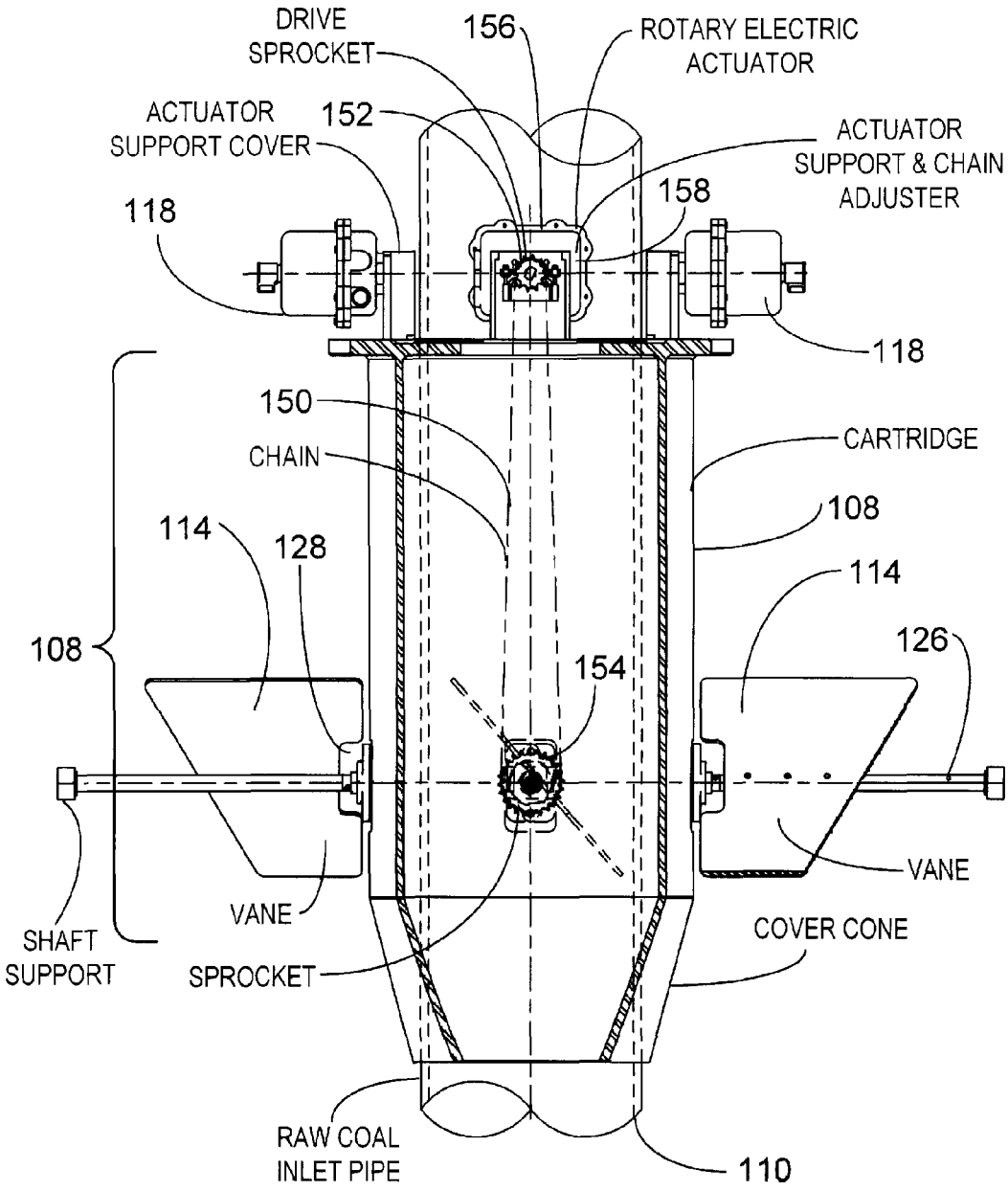
FIG. 6 is a cross-sectional close-up of the top portion of a coal pulverizer that contains a cartridge assembly in accordance with another embodiment of the present invention.

Turning to FIG. 6, FIG. 6 is a cross-sectional close-up view illustrating an alternative embodiment where the one or more vanes 114 of cartridge assembly 108 comprises at least one drive, or actuating, means 116 per vane that is a chain and sprocket drive. In this embodiment, the one or more chain and sprocket drives that act as drive, or actuating, means 116 comprise a chain 150 that is anchored at a top end and a bottom end with sprockets 152 and 154, respectively. In this embodiment sprocket 152 is a drive sprocket and is controlled and enabled to be moved via rotary electric actuator 156. Also included is a means by which to adjust the tension in chain 150 via chain adjuster 158. As can be seen from FIG. 6, sprocket 154 is operatively coupled to shaft 126 of a vane 114. Additionally, a protective cover plate shown behind bearing 128 is designed to prevent the inflow of coal dust into each respective drive means of this embodiment.

Figure 7:
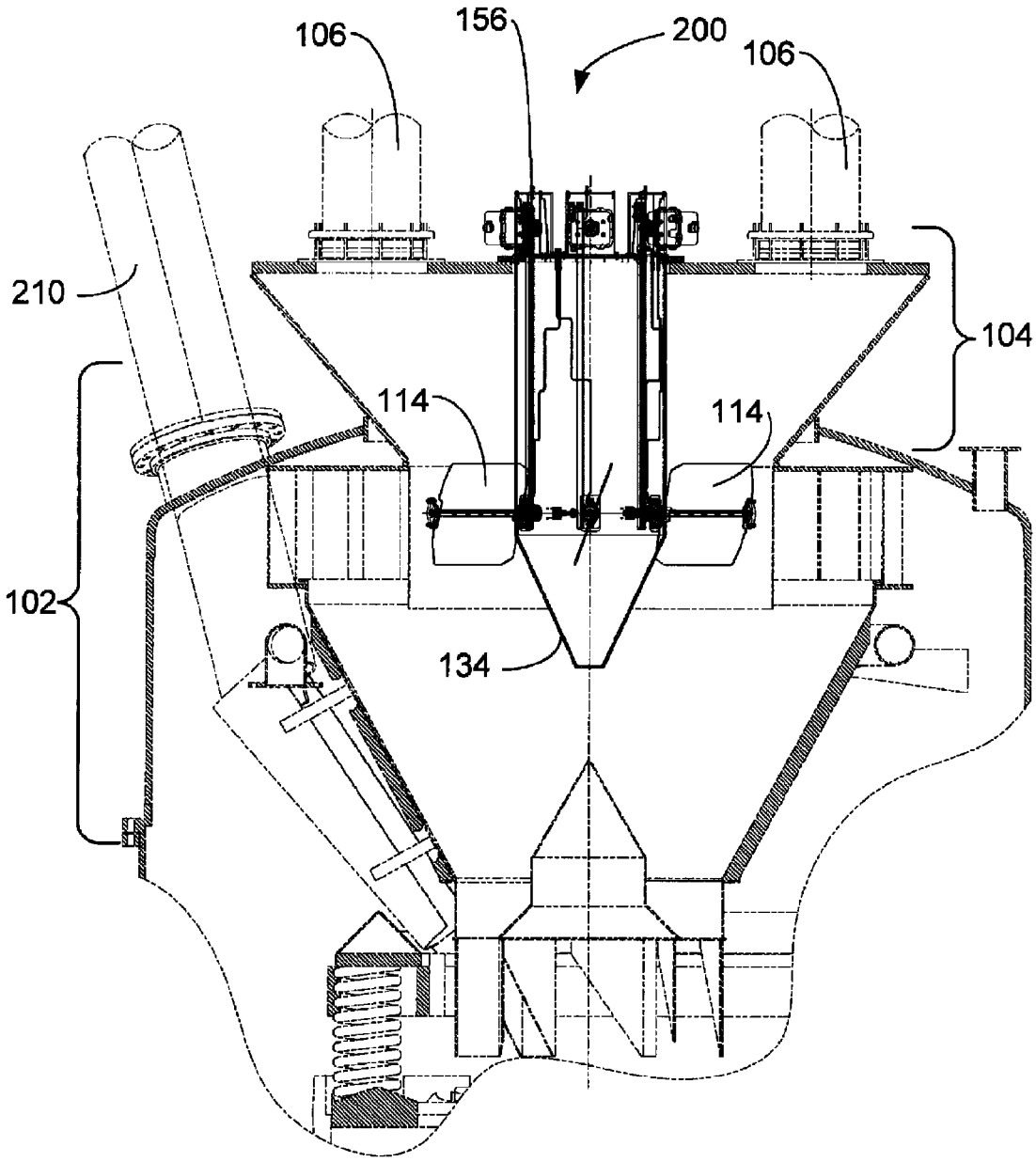
FIG. 7 is a cross-sectional close-up of the top portion of a coal pulverizer provided with side feed raw coal inlet pipe, provided with a cartridge assembly in accordance with another embodiment of the present invention.

Turning to FIG. 7, FIG. 7 is a cross-sectional close-up of the top portion of a coal pulverizer 200 provided with at least one side feed raw coal inlet pipe 210 that has been modified and/or provided with a cartridge assembly 108 in accordance with another embodiment of the present invention. In this embodiment, cartridge assembly 108 does not encircle, encompass and/or operatively engage the one or more coal inlet pipes 210.

Figure 8:
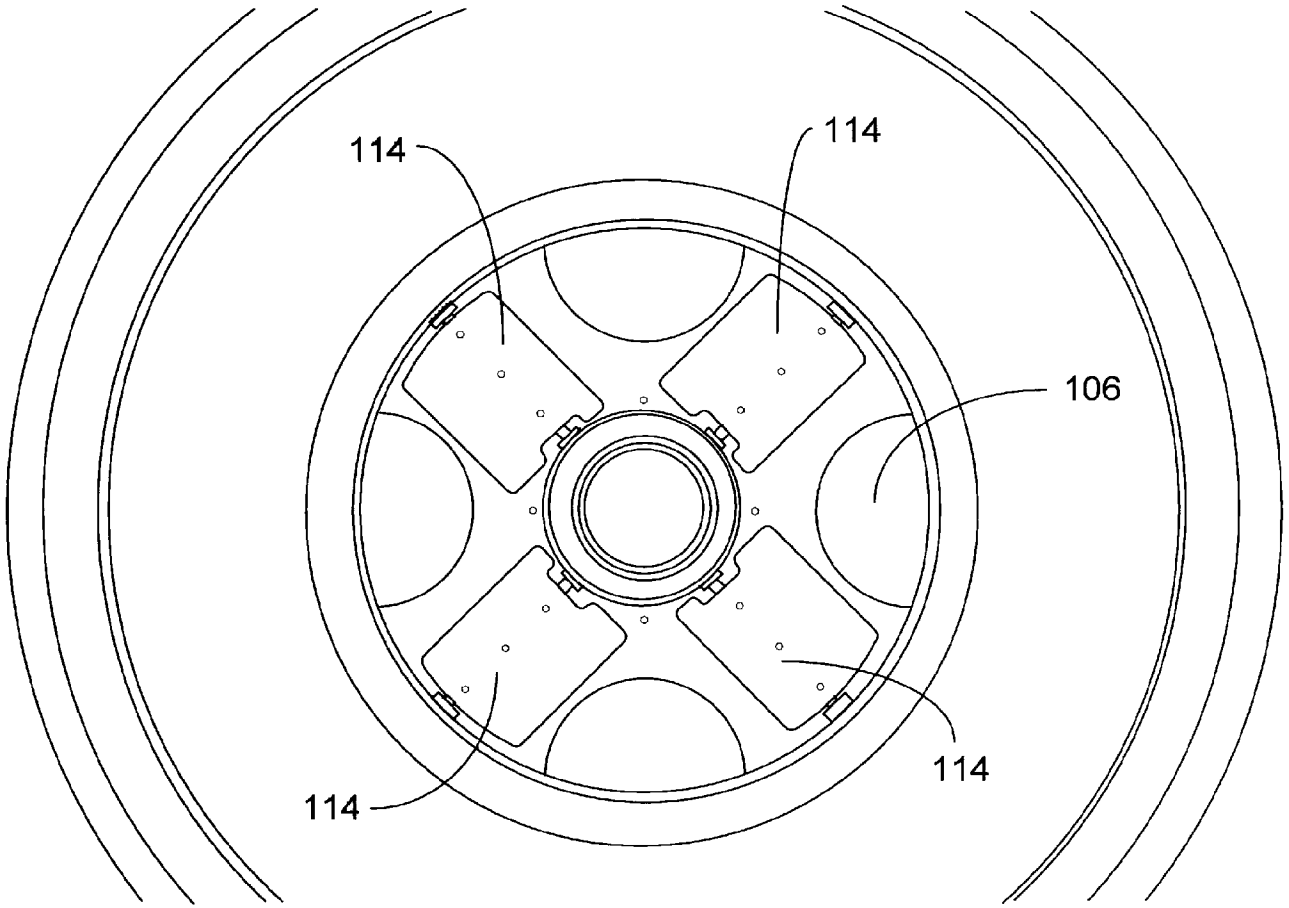
FIG. 8 is a view looking upwards from inside a coal pulverizer having a center feed raw coal inlet pipe, illustrating a coal pulverizer that contains a cartridge assembly in accordance with the embodiment of FIG. 2 of the present invention, wherein the number of vanes actuated by the cartridge assembly is equal to the number of coal outlet pipes provided on the coal pulverizer.
Figure 9:
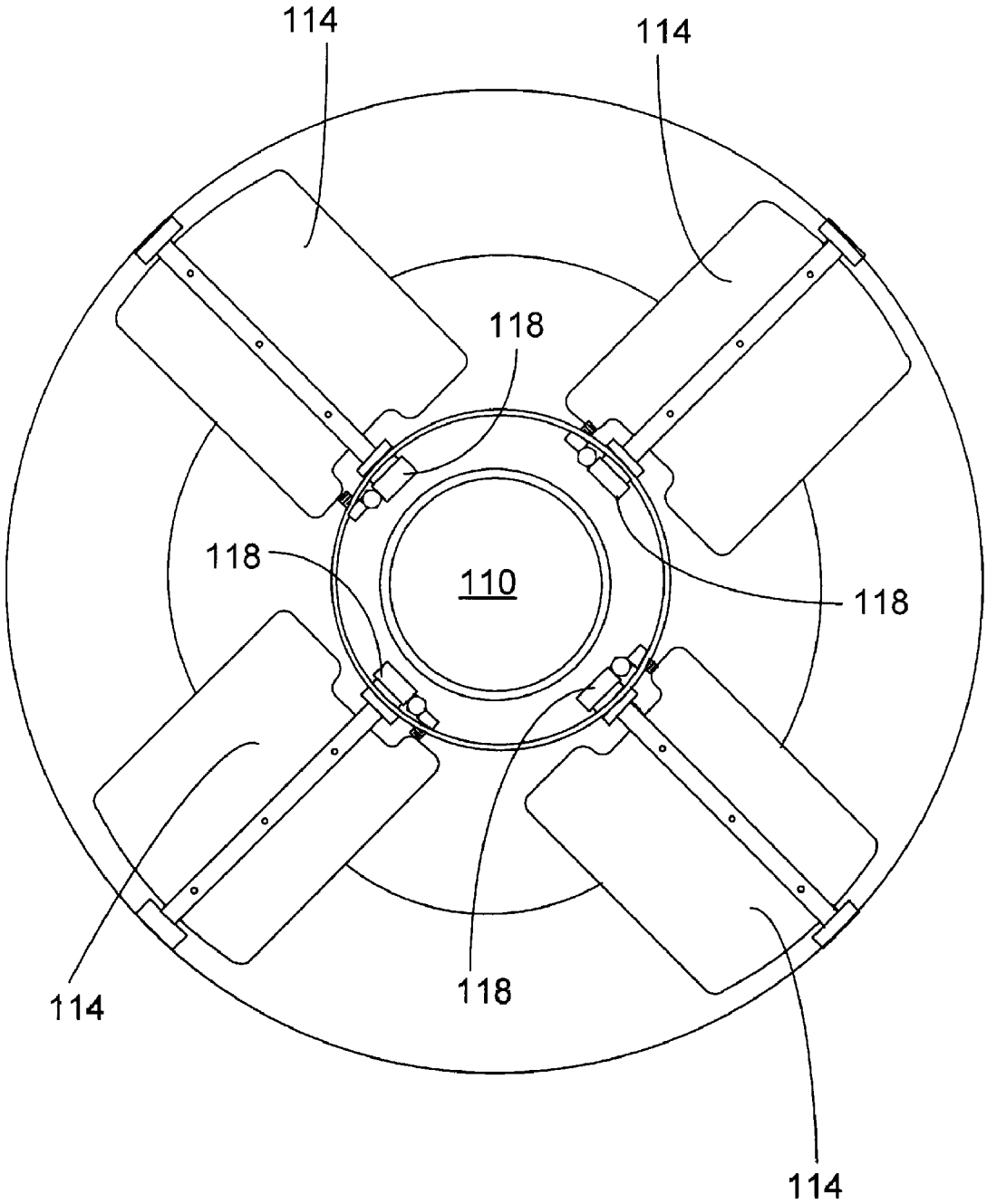
FIG. 9 is a top view of a cartridge assembly of the present invention, as embodied and located within the coal pulverizer of FIG. 8.

Regarding FIGS. 8 and 9, these Figs. are close-up views of various portions of coal pulverizer 100. Turning to FIG. 8, FIG. 8 is a view looking upwards from inside a coal pulverizer 100 having a center feed raw coal inlet pipe 110, illustrating a coal pulverizer that contains a cartridge assembly in accordance with the embodiment of FIG. 2 of the present invention, wherein the number of vanes actuated by the cartridge assembly is equal to the number of coal outlet pipes provided on the coal pulverizer. Turning to FIG. 9, FIG. 9 is a top view of a cartridge assembly of the present invention, as embodied and located within the coal pulverizer of FIG. 8.

Figure 10:
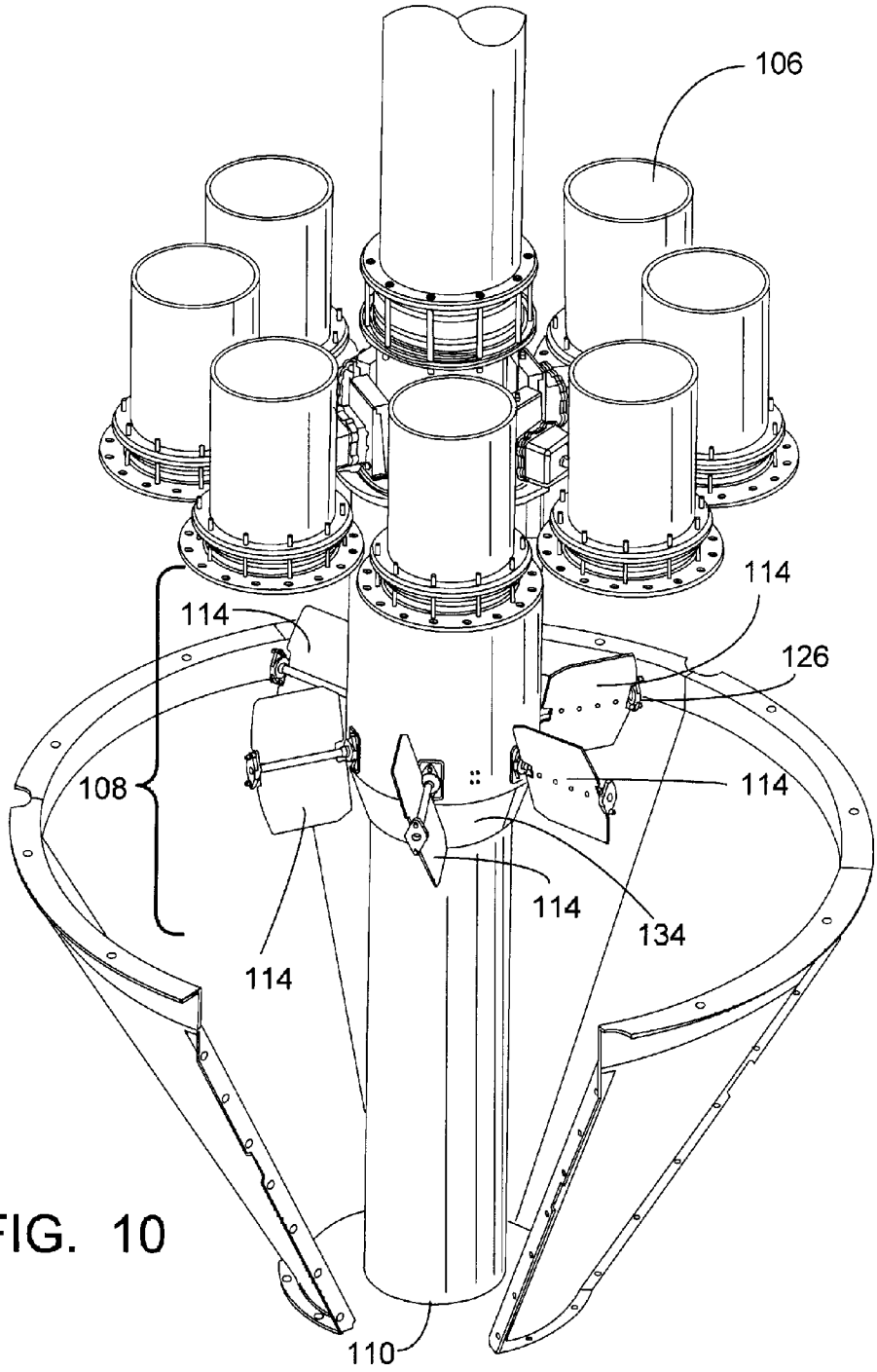
FIG. 10 is an isometric, cross-sectional close-up of another embodiment of the cartridge assembly of the present invention, wherein the number of vanes actuated by the cartridge assembly is less than the number of coal outlet pipes provided on the coal pulverizer.
Figure 11:
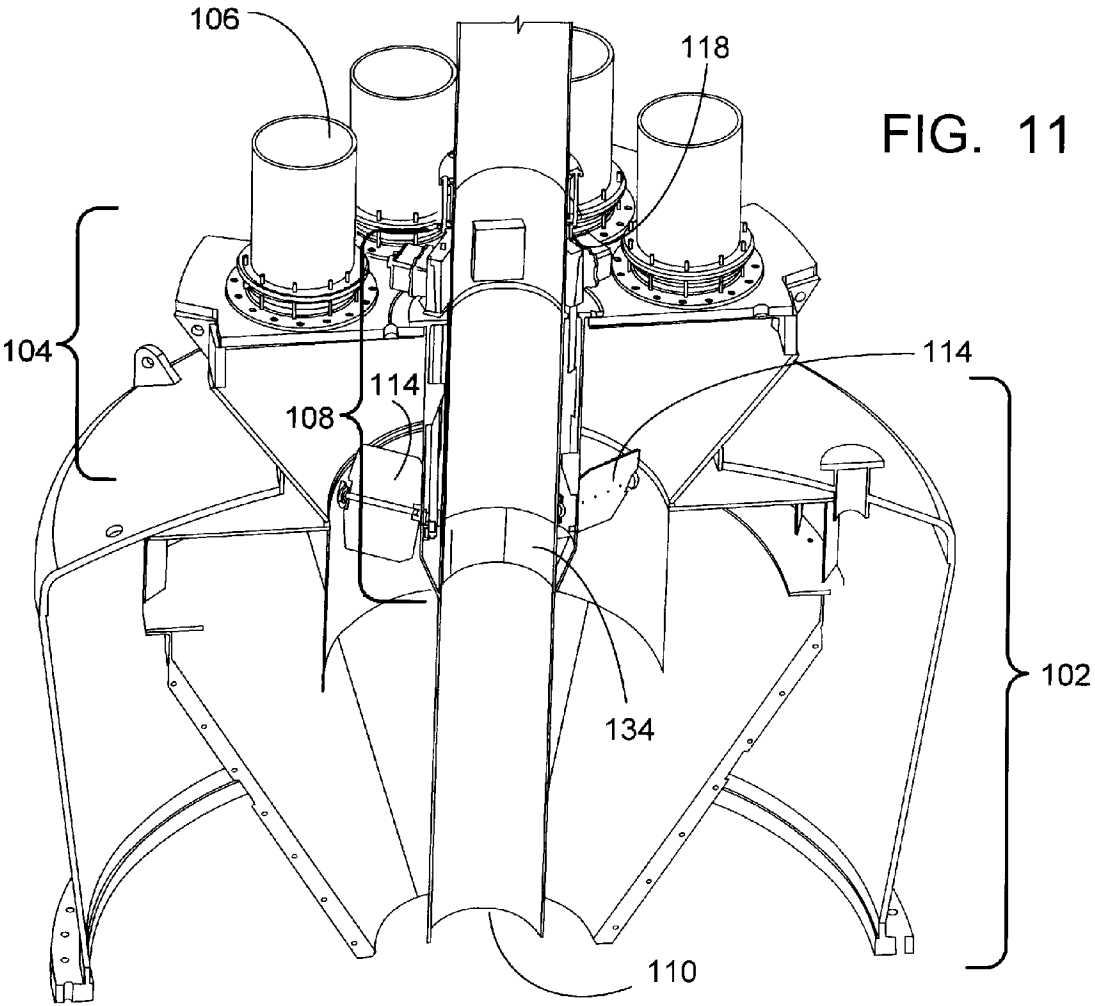
FIG. 11 is an isometric, cross-sectional close-up of another embodiment of the cartridge assembly of the present invention, wherein the number of vanes actuated by the cartridge assembly is less than the number of coal outlet pipes provided on the coal pulverizer.

Turning to FIGS. 10 and 11, FIGS. 10 and 11 disclose an embodiment where the number of vanes 114 is less than the number of coal outlet pipes 106. In the embodiment of FIGS. 10 and 11 the number of vanes is six and the number of coal outlet pipes is eight. Thus, in this embodiment, the number of vanes 114 can be equal to, less than, or even greater than the number of coal outlet pipes. The number of vanes utilized, the control scheme thereof, and the placement thereof is dependent upon a number of factors including, but not limited to, the amount of coal exiting each respective coal outlet pipe in a coal pulverizer, the flame characteristics of a burner attached to a respective coal outlet pipe, and/or various physical and/or engineering analyses (e.g., flow analysis, output analysis, etc.). In connection with all of the embodiments of the present invention where the cartridge assembly thereof has two or more vanes, each such vane can be controlled independently, in combination with one or more other vanes, or all together.

As explained above, several externally adjustable vanes 114 are arrayed between the classifier and the outlet of a pulverizer (see, e.g., FIGS. 1, 3 through 7, 10 through 12, and 14). In a neutral adjustment the one or more vanes 114 of the present invention are parallel to the helical flow of the air/coal mixture. The vanes can be individually and differentially adjusted to divert the air coal mixture flow path using an external actuator coupled to at least one drive, or actuating, means 116 per vane 114 as detailed above. Since the air recovers from the diversion quicker than the coal, the coal dust loading per unit volume of air exiting the pulverizer can be changed. This change is accomplished by use of cartridge assembly 108 which supports the one or more vanes 114, shaft 126 and bearing assembly 128. As detailed above, the design of various embodiment of cartridge assembly 108 protects the at least one drive, or actuating, means 116 per vane 114 from abrasive coal dust traveling through the classifier exit cylinder (see FIG. 3). The design of cartridge assembly 108 can be used on pulverizers with central raw coal inlet pipe or on pulverizers with a side feed raw coal inlet pipe. In addition to the drive, or actuating, means 116 discussed above, other methods of moving the vanes that are within the scope of the present invention include, but are not limited to, a worm gear driven by an external actuator.

Figure 12:
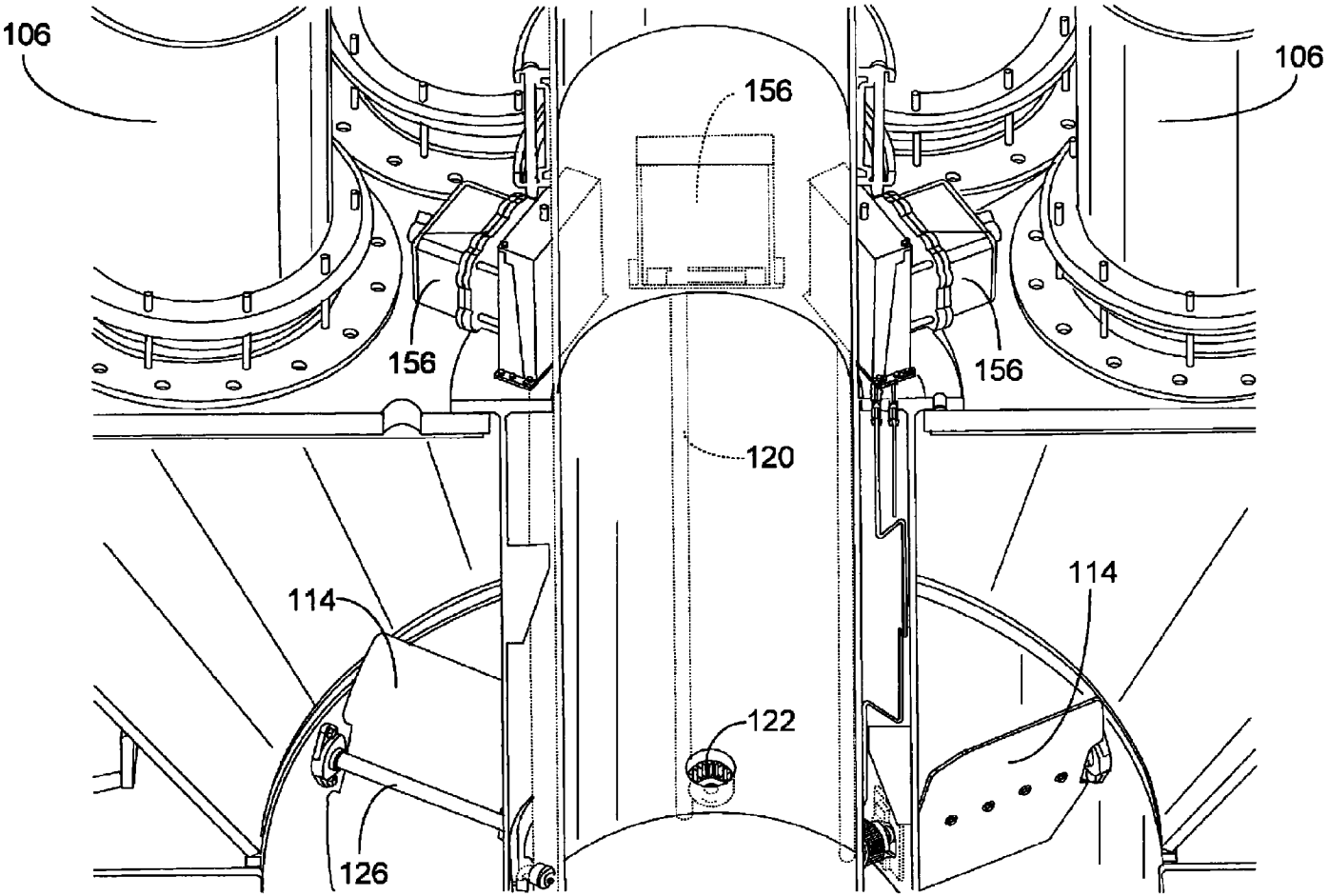
FIG. 12 is a cross-sectional, close-up view of a cartridge assembly of the present invention, where the cartridge assembly encircles a central raw coal inlet pipe provided on the coal pulverizer.
Figure 13:
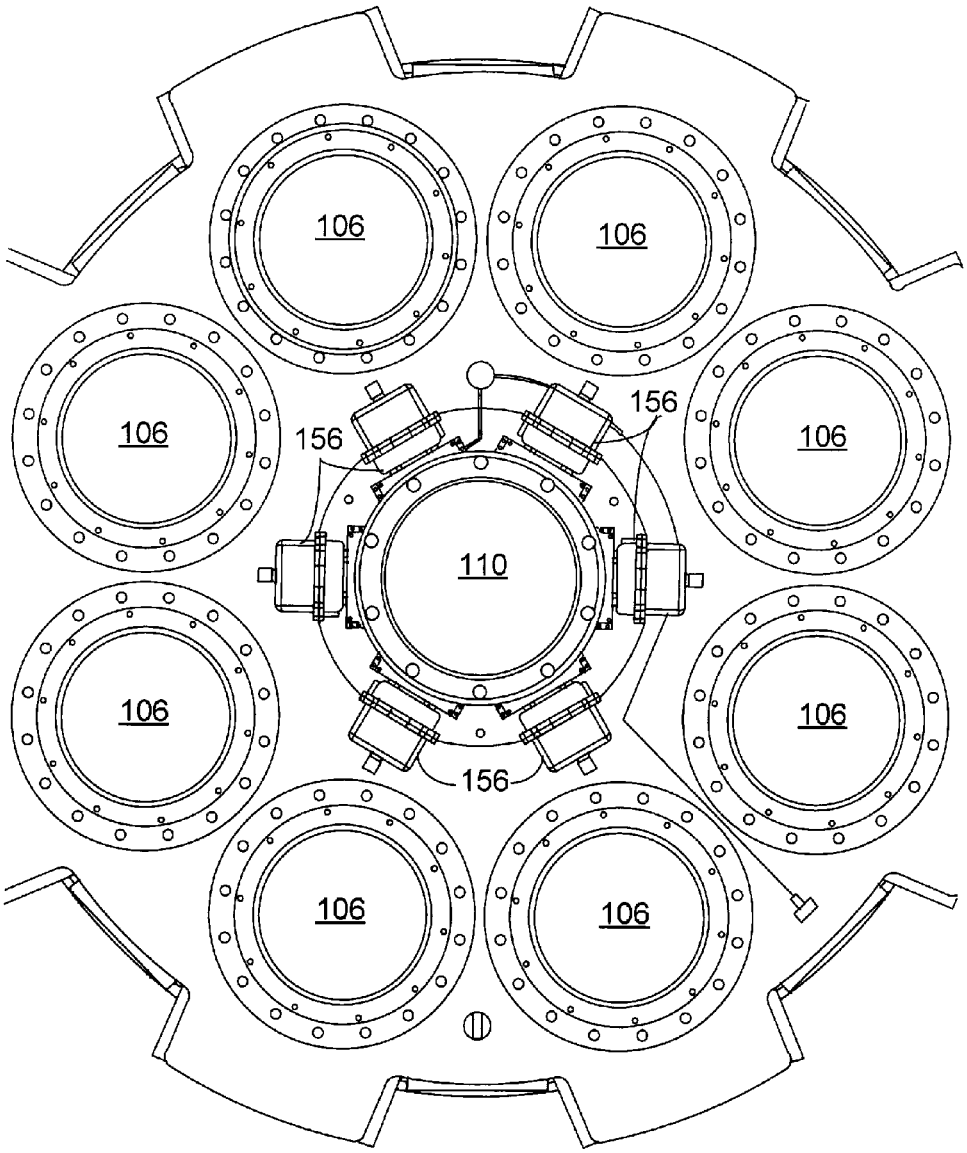
FIG. 13 is a plan view of a cartridge assembly of the present invention, where the cartridge assembly encircles a central raw coal inlet pipe provided on the coal pulverizer, and wherein the number of vanes actuated by the cartridge assembly is two less than the number of coal outlet pipes provided on the coal pulverizer.
Figure 14:
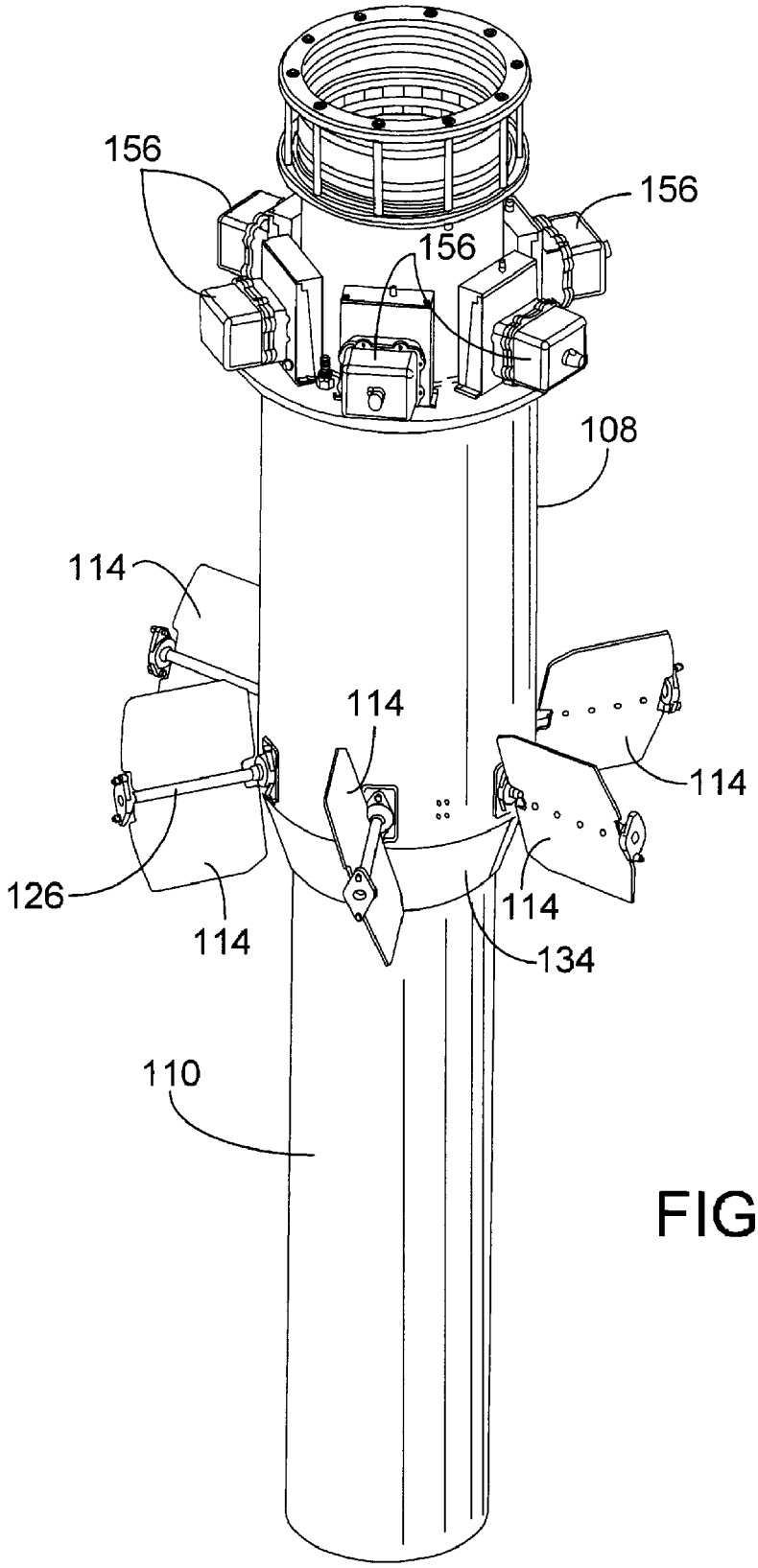
FIG. 14 is an isometric view of a cartridge assembly of the present invention, where the cartridge assembly encircles a central raw coal inlet pipe provided on the coal pulverizer.

Turning to FIGS. 12 through 14, these Figs. illustrate various other views and/or embodiments of the present invention. Specifically, FIG. 12 is a cross-sectional, close-up view of a cartridge assembly of the present invention, where the cartridge assembly encircles a central raw coal inlet pipe provided on the coal pulverizer. Regarding FIG. 13, FIG. 13 is a plan view of a cartridge assembly of the present invention, where the cartridge assembly encircles a central raw coal inlet pipe provided on the coal pulverizer, and wherein the number of vanes actuated by the cartridge assembly is two less than the number of coal outlet pipes provided on the coal pulverizer. Finally, FIG. 14 is an isometric view of a cartridge assembly of the present invention, where the cartridge assembly encircles a central raw coal inlet pipe provided on the coal pulverizer.

Altering the coal dust loading per volume of primary air allows altering the coal flow to each burner without altering the primary air flow. Primary air flow is important to both the velocity at which the air/coal mixture exits the burner fuel nozzle, and to the distribution of total air at the burner. Both are important to optimize combustion.

With regard to the above embodiments, the present invention permits the elimination of any potential interference, or conflict, between the drive means for one or more coal flow vanes and any swing valves that are present in the upper internal portion of the coal pulverizer (i.e., the turret). As would also be appreciated by those of skill in the art, the present invention is not solely limited to low, or no, turret coal pulverizers. Rather, the present invention can be applied to any coal pulverizer where it is desirable to control one or more coal flow vanes from an internally located surface.

Additionally, the present invention can be retrofitted to existing coal pulverizers to permit the systematic, or individual, control of coal to one or more coal outlet pipes in a coal pulverizer via the positioning of the one or more coal flow vanes.

While specific embodiments of the present invention have been shown and described in detail to illustrate the application and principles of the invention, it will be understood that it is not intended that the present invention be limited thereto and that the invention may be embodied otherwise without departing from such principles. In some embodiments of the invention, certain features of the invention may sometimes be used to advantage without a corresponding use of the other features. Accordingly, all such changes and embodiments properly fall within the scope of the following claims.

What is claimed is:

1. A system for controlling one or more coal flow vanes in a coal pulverizer via an internal control system, the internal control system comprising:

a cartridge assembly designed to operatively engage and/or be positioned in an upper portion of a coal pulverizer, the cartridge assembly comprising:

at least two coal flow vanes; and at least one drive, or actuating, means per coal flow vane, wherein the at least one drive, or actuating, means is operatively coupled to a coal flow vane, wherein the location of the cartridge assembly is selected so that each of the at least two coal flow vanes can affect the output of pulverized coal in at least one outlet pipe of the coal pulverizer.

2. The system of claim 1, wherein the number of coal flow vanes is equal to the number of coal outlet pipes in a coal pulverizer.

3. The system of claim 1, wherein the number of coal flow vanes is less than the number of coal outlet pipes in a coal pulverizer.

4. The system of claim 1, wherein the number of coal flow vanes is greater than the number of coal outlet pipes in a coal pulverizer.

5. The system of claim 1, where each coal flow vane is designed to be independently actuated.

6. The system of claim 1, wherein the at least one drive, or actuating, means per coal flow vane is selected from a rack and pinion drive, chain and sprocket drive, or a combination thereof.

7. The system of claim 1, wherein the cartridge assembly is designed to operatively engage, or encircle, a portion of a coal inlet pipe in an internal portion of a coal pulverizer.

8. A system for controlling one or more coal flow vanes in a coal pulverizer via an internal control system, the internal control system comprising:

a cartridge assembly designed to operatively engage and/or be positioned in an upper portion of a coal pulverizer, the cartridge assembly comprising:

at least two coal flow vanes; and at least one drive, or actuating, means per coal flow vane, wherein the at least one drive, or actuating, means is operatively coupled to a coal flow vane, wherein the location of the cartridge assembly is selected so that each of the at least two coal flow vanes can affect the output of pulverized coal in at least one outlet pipe of the coal pulverizer, and wherein the at least two coal flow vanes are positioned at equal intervals around an external surface of a coal inlet pipe of the coal pulverizer.

9. The system of claim 8, wherein the number of coal flow vanes is equal to the number of coal outlet pipes in a coal pulverizer.

10. The system of claim 8, wherein the number of coal flow vanes is less than the number of coal outlet pipes in a coal pulverizer.

11. The system of claim 8, wherein the number of coal flow vanes is greater than the number of coal outlet pipes in a coal pulverizer.

12. The system of claim 8, where each coal flow vane is designed to be independently actuated.

13. The system of claim 8, wherein the at least one drive, or actuating, means per coal flow vane is selected from a rack and pinion drive, chain and sprocket drive, or a combination thereof.

14. The system of claim 8, wherein the cartridge assembly is designed to operatively engage, or encircle, a portion of a coal inlet pipe in an internal portion of a coal pulverizer.

15. A method for controlling the output of coal in a plurality of coal outlet pipes in a coal pulverizer, the method comprising the steps of:

modifying, or retrofitting, a portion of a coal pulverizer with a cartridge assembly designed to operatively engage and/or be positioned in an upper portion of a coal pulverizer, the cartridge assembly comprising:

at least two coal flow vanes; and at least one drive, or actuating, means per coal flow vane, wherein the at least one drive, or actuating, means is operatively coupled to a coal flow vane; and controlling either independently, or in combination, the at least two coal flow vanes so as to modify, or control, the amount of coal exiting at least one coal outlet pipe in a coal pulverizer, wherein the location of the cartridge assembly is selected so that each of the at least two coal flow vanes can affect the output of pulverized coal in at least one outlet pipe of the coal pulverizer.

16. The method of claim 15, wherein the number of coal flow vanes is equal to the number of coal outlet pipes in a coal pulverizer.

17. The method of claim 15, wherein the number of coal flow vanes is less than the number of coal outlet pipes in a coal pulverizer.

18. The method of claim 15, wherein the number of coal flow vanes is greater than the number of coal outlet pipes in a coal pulverizer.

19. The method of claim 15, where each coal flow vane is designed to be independently actuated.

20. The method of claim 15, wherein the at least one drive, or actuating, means per coal flow vane is selected from a rack and pinion drive, chain and sprocket drive, or a combination thereof.

21. The method of claim 15, wherein the cartridge assembly is designed to operatively engage, or encircle, a portion of a coal inlet pipe in an internal portion of a coal pulverizer.

* * * * *